US005154655A

United States Patent [19]

Glydon

[11] Patent Number: 5,154,655

[45] Date of Patent: Oct. 13, 1992

[54] LEASH CONNECTOR AND SPORTS BOARD COMBINATION THEREWITH

[75] Inventor: Jon A. Glydon, West Barnstaple, Mass.

[73] Assignee: Packaging Industries Group, Inc., Hyannis, Mass.

[21] Appl. No.: 614,224

[22] Filed: Nov. 16, 1990

[51] Int. Cl.[5] ..... A63C 15/06

[52] U.S. Cl. ..... 441/75; 410/113; 441/65

[58] Field of Search ..... 441/65-70, 441/74, 75, 129, 130, 136; 114/249, 253; 410/101-116; 24/109

[56] References Cited

U.S. PATENT DOCUMENTS

| | | | |
|---|---|---|---|
| 2,740,361 | 4/1956 | Goldberg | 410/113 |
| 4,267,615 | 5/1981 | Nealy | 441/75 |
| 4,708,675 | 11/1987 | Shoeffler et al. | 441/65 |
| 4,820,220 | 4/1989 | Fruzzetti et al. | 441/74 |

*Primary Examiner*—Jesus D. Sotelo

*Attorney, Agent, or Firm*—Dickinson, Wright, Moon, Van Dusen & Freeman

[57] ABSTRACT

A connector for securing a leash to a sports board includes a plate having a substantially planar upper surface for receiving graphics. The plate is hinged to a flange, molded integrally with the plate, which receives the leash. The connector is inserted through the board so that the plate is substantially coplanar with an upper surface of the board and the flange extends upwardly therefrom.

11 Claims, 1 Drawing Sheet

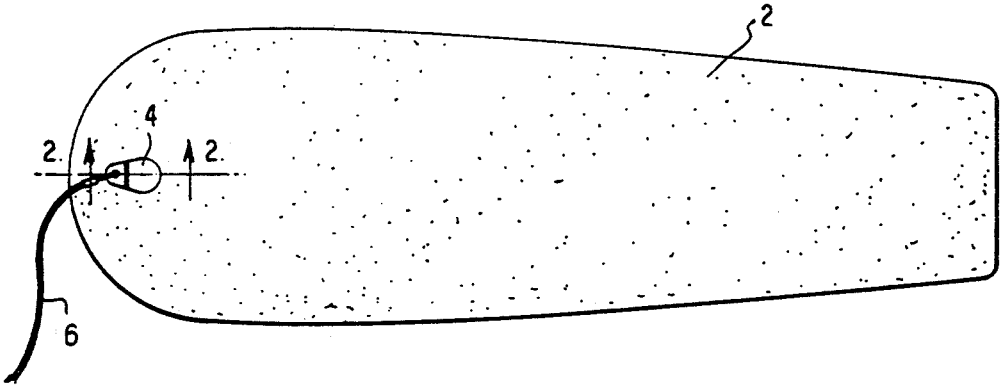
FIG. 1
FIG. 4
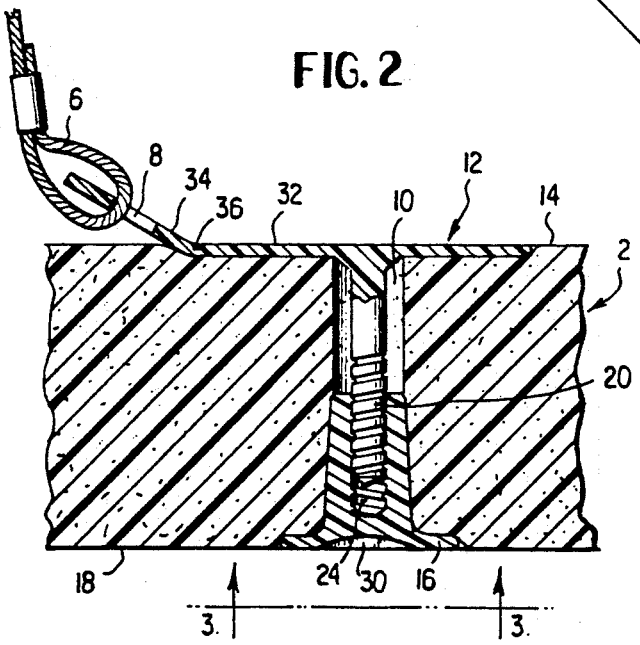
FIG. 2
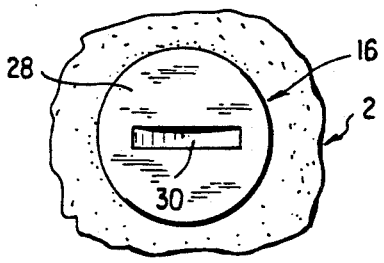
FIG. 3
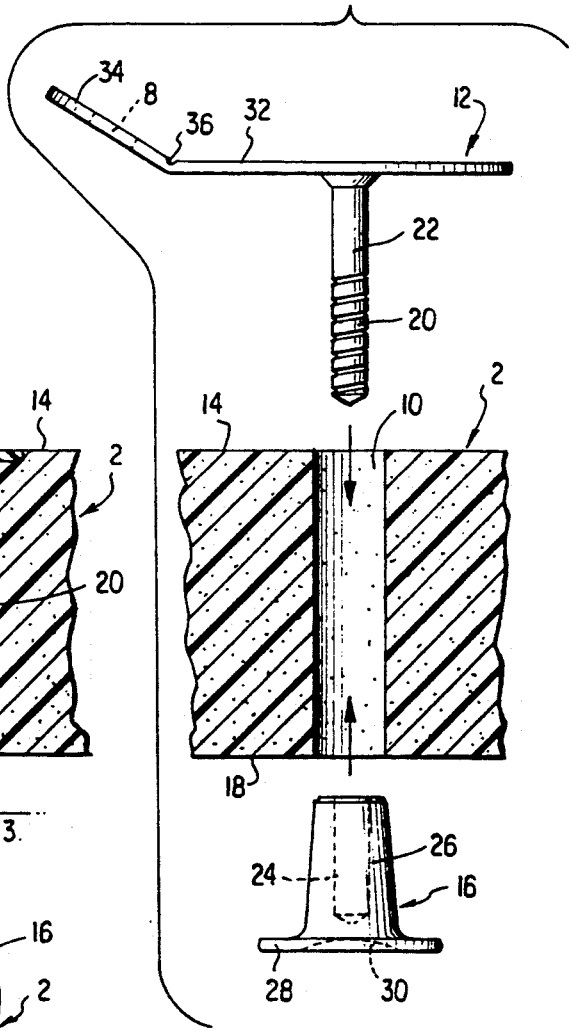

LEASH CONNECTOR AND SPORTS BOARD COMBINATION THEREWITH

FIELD OF THE INVENTION

The invention relates to a device for connecting a leash to a surfboard, bodyboard or other sports board, which is generally a foam board.

BACKGROUND OF THE INVENTION

Known devices for connecting a leash to a surfboard have disadvantages in that the leash is attached to the upper surface of a plug through the board, which does not present a flat surface, flush with the board, for receiving the trademark and name of the product or any advertising.

Nealy, U.S. Pat. No. 4,267,615, describes a leash to surf mat connector which is fastened through the board. The upper surface of the connector is slotted to receive a leash and has a domed surface to allow space for the slotted portion above the surface of the board. Even though, according to Nealy, the board may be compressed, the slotted, domed surface is still raised above the surface of the board.

The patent to Fruzzetti et al., U.S. Pat. No. 4,820,220 describes a surfboard tether which is plugged into the top surface of a surfboard. The leash may be attached within the body of the plug or attached to flanges extending from a plug raised above the surface of the board.

The patent to Newland, et al., U.S. Pat. No. 4,107,806, describes another anchoring device which is cemented into the upper surface of a surfboard, for receiving a leash. Brown, U.S. Pat. No. 3,802,374, describes a surfboard towing device in which a plug inserted in the underside of the surfboard receives a leash connecting the board to a towing boat.

SUMMARY OF THE INVENTION

A connector for securing a leash to a sports board includes a plate having a substantially planar upper surface for receiving graphics. The plate is hinged to a flange, molded integrally with the plate, which receives the leash. The connector is inserted through the board so that the plate is substantially coplanar with an upper surface of the board and the flange extends upwardly therefrom.

It is an object of the invention to provide a connector for securing a leash to a sports board in which the connector includes a flat plate for receiving graphics.

It is another object of the invention to provide a connector in which the upper plate is substantially coplanar with the upper surface of the board to which it is connected.

It is a further object of the invention to provide a sports board combined with a connector having an upper plate which is substantially coplanar with the upper surface of the board.

BRIEF DESCRIPTION OF THE DRAWINGS

FIG. 1 is a top plan view of a leash connector of the invention inserted in a surfboard.

FIG. 2 is a cross-sectional view taken on line 2—2 of FIG. 1.

FIG. 3 is a plan view of the underside of a leash connector taken on line 3—3 of FIG. 2.

FIG. 4 is an exploded view showing assembly of the leash connector with a surfboard.

DETAILED DESCRIPTION OF THE INVENTION

A leash connector of the invention is unexpectedly advantageous in that a flat plate, substantially coplanar with the upper surface of the board to which it is connected, is provided for receiving graphics. The leash is connected to the board by means of a flange hinged to the plate.

With reference to the Figures, in which like numerals represent like parts, FIG. 1 shows sports board 2 having leash connector 4 attached thereto. Leash 6 is attached to connector 4 through slot 8, shown in FIG. 2. Sports board 2 may be a surfboard, bodyboard, snow board or other sports board known in the art. Sports board 2 is preferably a resilient foam board, but may be made of other materials appropriate to the purpose.

FIGS. 2 to 4 show assembly of the leash connector with a surfboard. A channel 10 is drilled through board 2. Upper portion 12 of connector 4 is inserted into channel 10 from upper surface 14 of board 2. Lower portion 16 of connector 4 is inserted into channel 10 form lower surface 18 of board 2. Threads 20 on an outer surface of shaft 22 of upper portion 12 engage corresponding threads 24 on an inner surface of shaft 26 of lower portion 16. Lower portion 16 has a flat outer surface 28 which may have a slot 30, for receiving a screwdriver, therein.

Upper portion 12 and lower portion 16 are each molded from plastic material, as is known in the art. Plate 32 of upper portion 12 is separated from flange 34 by a plastic hinge 36. Plastic hinge 36 is formed by molding a thinner substantially linear section between plate 32 and flange 34. Other methods of providing a hinge are known in the art.

Upper portion 12 and lower portion 16 are engaged together by engaging threads 20 and 24 together. Shaft 22 of upper portion 22 is screwed sufficiently far into shaft 26 of lower portion 16 so that plate 32 is substantially coplanar with upper surface 14 of board 2 and lower surface 28 of lower portion 16 is substantially coplanar with lower surface 18 of board 2, optionally slightly compressing the body of board 2 and securing connector 4 firmly into board 2. Thus, flange 34 extends outward and upward from plate 32, separated by plastic hinge 36.

Plate 32 is preferably flat and may be any shape, such as substantially circular, hexagonal or other shape known in the art. Graphics are displayed on the upper surface of plate 32. Due to the flat, unbroken surface of plate 32, graphics are readily applied to plate 32 and readily viewed by a user.

Other non-limiting embodiments of the invention include providing a male threaded shaft on the lower portion of the connector and providing a female threaded shaft on the upper portion of the connector, or providing different means for securing the upper portion and the lower portion of the connector together.

While the invention has been described above the with respect to certain embodiments thereof, it will be appreciated that variations and modifications may be made without departing from the spirit and scope of the invention.

What is claimed is:

1. A connector for securing a leash to a sports board comprising:

plate means for receiving graphics;

flange means hinged to said plate means for receiving a leash;

shaft means attached to a lower surface of said plate means for inserting through a top surface of a sports board into a channel through the board; and connecting means for inserting through a lower surface of the board into the channel for engaging with said shaft means;

whereby said shaft means and said connecting means are engaged together so that said plate means is substantially coplanar with an upper surface of the sports board.

2. A connector according to claim 1 further comprising hinge means for connecting said plate means and said flange means.

3. A connector according to claim 2 wherein said hinge means is molded integrally with said plate means and said flange means.

4. A connector according to claim 3 wherein said plate means and said flange means are of substantially the same thickness and said hinge means is of lesser thickness.

5. A connector according to claim 1 wherein said plate means comprises a substantially planar upper surface.

6. A connector according to claim 1 wherein said plate means further comprises a substantially planar lower surface.

7. A connector according to claim 5 wherein said flange means comprises substantially planar opposite surfaces.

8. A connector according to claim 7 wherein said flange means further comprises channel means for receiving a leash extending between said surfaces.

9. A connector for securing a leash to a sports board comprising:

plate means comprising a substantially planar upper surface for receiving graphics;

flange means hinged to said plate means for receiving a leash;

hinge means extending between said plate means and said flange means and molded integrally therewith;

shaft means attached to a lower surface of said plate means for inserting through a top surface of the sports board into a channel through the sports board; and connecting means for inserting through a lower surface of the sports board into the channel for engaging with said shaft means;

whereby said shaft means and said connecting means are engaged together so that said plate means is substantially coplanar with an upper surface of the sports board.

10. A sports board combination comprising a sports board and a connector for joining a leash to said board wherein said connector comprises a plate substantially coplanar with an upper surface of said sports board, wherein said connector further comprises flange means hinged to said plate means for receiving the leash.

11. A sports board combination comprising a sports board and a connector according to claim 1 for joining a leash to said board.

* * * * *